United States Patent [19]

Yokoyama

[11] 4,005,353

[45] Jan. 25, 1977

[54] DIRECT CURRENT VOLTAGE REGULATING CIRCUITRY

[75] Inventor: Kenji Yokoyama, Hamamatsu, Japan

[73] Assignee: Nippon Gakki Seizo Kabushiki Kaisha, Hamamatsu, Japan

[22] Filed: Apr. 23, 1975

[21] Appl. No.: 570,964

[30] Foreign Application Priority Data

Apr. 25, 1974 Japan ..... 49-47016

[52] U.S. Cl. ..... 323/22 R; 323/1; 323/22 T

[51] Int. Cl.[2] ..... G05F 1/56

[58] Field of Search ..... 307/296, 297; 323/1, 323/4, 16, 19, 22 R

[56] References Cited

UNITED STATES PATENTS

| | | | |
|---|---|---|---|
| 3,417,319 | 12/1968 | Shaughnessy | 323/22 R |
| 3,562,729 | 2/1971 | Hurd | 323/16 X |
| 3,571,694 | 3/1971 | Hunger et al. | 323/16 X |
| 3,577,063 | 5/1971 | Hurd | 323/16 |
| 3,875,430 | 4/1975 | Prak | 307/297 |
| 3,899,693 | 8/1975 | Gaudreault | 307/297 |

OTHER PUBLICATIONS

Wu, "Designing Power Supplies with FETs", EEE, Dec. 1968, vol. 16, No. 12, pp. 68, 69.

*Primary Examiner*—A. D. Pellinen
*Attorney, Agent, or Firm*—Cushman, Darby & Cushman

[57] ABSTRACT

In series in a load current path between an input terminal and an output terminal is connected a variable resistance element having a control terminal to constitute a series-type direct current voltage regulating circuitry. An error amplifier includes a field effect transistor (FET) having a triode characteristic, a constant current circuit as a load in the drain circuit and a variable resistor in the source circuit to provide a variable reference voltage. The voltage at the output terminal is divided by a resistor network and applied to the gate of FET. The drain voltage of the FET is applied to the control terminal of the variable resistance element. Such a configuration provides a simple circuit arrangement and an excellent voltage regulation.

7 Claims, 6 Drawing Figures

DIRECT CURRENT VOLTAGE REGULATING CIRCUITRY

BACKGROUND OF THE INVENTION

1. Field of the Invention

The present invention is concerned with a direct current voltage regulating circuitry which is connected in series between an unregulated DC supply source and a load to which a current is supplied from said DC supply source to keep the applied voltage constant. More particularly, the present invention pertains to a series DC voltage regulating circuitry of the continuously controllable type which is arranged such that a variable resistance element is connected in series in the load current path, to be operative so that in case the voltage applied to the load, i.e. the output voltage, varies from its set value resulting in a deviation, the internal resistance of the variable resistance element is increased or decreased in accordance with the variation of the output voltage, whereby this output voltage is kept at the set value.

2. Brief Description of the Prior Art

A series DC voltage regulating circuitry of the continuously controllable type is comprised, basically, of: a variable resistance element connected in series to the load current path; an output voltage detecting circuit for providing a voltage proportional to the output voltage; a reference voltage source for generating a reference voltage; and an error amplifier for comparing the voltage proportional to the output voltage detected with the reference voltage by means of a detecting circuit and to amplify the resulting error (difference between the two) voltage and to supply this amplified error voltage to the control terminal of the variable resistance element (There may be an instance where said comparison and said amplification of the error voltage are performed by respectively separate circuits.).

Of the aforesaid component elements of the regulating circuitry, the error amplifier and the reference voltage source constitute the most important parts of the circuitry, and accordingly the ability of the whole circuitry is substantially determined by the abilities of these constituting elements. The reference voltage source must be one which always generates a certain constant reference voltage. For example, when the reference voltage is changed due to the change in the ambient temperature, this voltage change will in turn result in a drift of the output voltage. The error amplifier must also be such that its gain and the like are not affected by the fluctuations of the ambient temperature, and that it has a good linearity and a high gain.

In the past, a bipolar transistor has been used as the active element of the aforesaid error amplifier, whereas a voltage regulator diode such as a Zener diode has been used as the reference voltage source. However, the characteristics of such bipolar transistor and Zener diode are significantly affected by ambient temperature as is well known. For this reason, in the conventional DC voltage regulating circuitry, there have been attempts to additionally provide a temperature compensating circuit on both the error amplifier and the reference voltage source for compensating for the effects of the ambient temperature, or a need has been noted to use, in the reference voltage source, an expensive voltage regulator diode of a temperature-compensating type. Thus, the whole circuitry has tended to become complicated. Moreover, even in case such a temperature compensating element as stated above is provided, it has not been necessarily possible to obtain a sufficiently desirable result. Furthermore, there has been the problem that the necessitated increase of the required number of active elements and like parts has constituted an important cause of the degradation of reliability of the circuitry.

On the other hand, the DC voltage regulating circuitry is required so that its output voltage can be varied extensibly depending on its use. In the conventional circuitry having the aforesaid arrangement, however, the reference voltage is determined by the voltage regulator diode. Also, even in the event that the reference voltage is divided by, for example, a divider circuit to provide other reference voltages equivalently, there still is an increased fear that the stability of the reference voltage against, for example, ambient temperature becomes degraded. In addition, there has been a tendency to develop fluctuations of the gain and the linearity of the error amplifier and to develop a deterioration of the temperature compensating effect. Thus, it has been quite difficult to make it possible to change the setting of the output voltage as desired.

SUMMARY OF THE INVENTION

Therefore, a primary object of the present invention is to provide a direct current voltage regulating circuitry having a simple arrangement and having an excellent stability of the output voltage against changes of the input voltage and the load current.

Another object of the present invention is to provide a DC voltage regulating circuitry of the type described which can provide various output voltage settings over a wide range.

Still another object of the present invention is to provide a DC voltage regulating circuitry of the type described whose output voltage is not varied by the variation of the ambient temperature.

Yet another object of the present invention is to provide a DC voltage regulating circuitry of the type described which is simple in design and regulation and which is superior in its functional reliability.

These as well as other objects, features and advantages of the present invention will become apparent from the following detailed description of the present invention when taken in conjunction with the accompanying drawings.

DETAILED DESCRIPTION OF THE PREFERRED EMBODIMENTS

Figure 1:
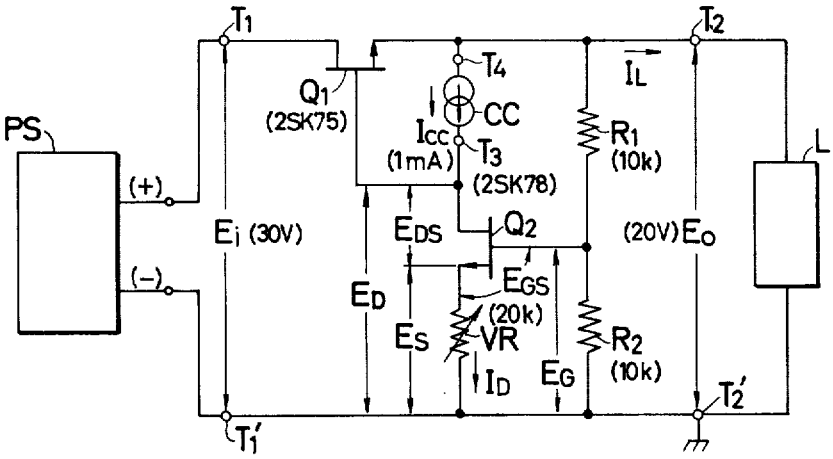
FIG. 1 is a diagram of an electric circuit showing an example of the direct current voltage regulating circuit of the present invention.

In FIG. 1, symbols $T_1$ and $T_1'$ represent a pair of input terminals. Symbols $T_2$ and $T_2'$ represent a pair of output terminals. An unregulated DC power source PS is connected between the input terminals $T_1$ and $T_1'$. A load L is connected between the output terminals $T_2$ and $T_2'$. Also, input terminal $T_1'$ and output terminal $T_2'$ are connected, respectively, to the basic potential point (e.g. ground) of the circuitry.

Between the terminal $T_1$ and the terminal $T_2$ which form the path of the load current $I_L$ is connected in series a field effect transistor (hereinafter to be referred to simply as FET) $Q_1$ having either a pentode characteristic or triode characteristic and serving as a variable resistor element. The gate electrode of this FET $Q_1$ which constitutes a control terminal is connected to the drain electrode of the FET $Q_2$ having a triode characteristic (a characteristic similar to that of a vacuum tube triode) which forms an error amplifier.

The drain electrode of the FET $Q_2$ having a triode characteristic is connected via a constant current circuit CC to the output terminal $T_2$. The source electrode of this FET $Q_2$ is connected via a variable resistor VR to the ground line of the circuitry. The gate electrode of the FET is $Q_2$ connected to a connection point of resistors $R_1$ and $R_2$ which are connected across the output terminals $T_2$ and $T_2'$ and serve as the detecting circuit.

Figure 2:
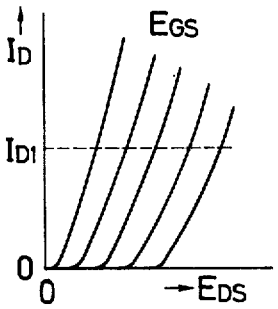
FIG. 2 is a diagram showing the $E_{DS}$-$I_D$ characteristic of an FET having a triode characteristic.

The FET $Q_2$ having a triode characteristic has a characteristic closely resembling that of a vacuum tube triode as shown in FIG. 2 in contrast to the conventional FET which has a characteristic closely resembling that of a vacuum tube pentode. Accordingly, in case there flows a drain current $I_{DI}$ having a certain constant value, the drain-source voltage $E_{DS}$ varies substantially in proportion to the gate-source voltage $E_{GS}$. And, in case these conditions are satisfied, there can be achieved a great amplification factor which is equivalent to the voltage amplification factor $\mu$ of the FET itself, as will be apparent from FIG. 3.

This example of the present invention satisfies the above-stated conditions.

More specifically, a constant current $I_{CC}$ flows via the constant current circuit CC to the FET $Q_2$. Accordingly, the drain-source voltage $E_{DS}$ varies while being amplified by the amount of the voltage amplification factor $\mu$ of the FET $Q_2$ in proportion to the gate-source voltage $E_{GS}$. It is needless to say that the phase is inverted. Since the drain current $I_D$ of the FET $Q_2$ is equal to the constant current $I_{CC}$ and is constant, the voltage $E_S$ across the terminals of the variable resistor VR takes a constant value which is determined by the resistance value of said variable resistor VR. As a result, the voltage $E_S$ across the terminals can be used as a reference voltage. The gate-source voltage $E_{GS}$ of the FET $Q_2$ will increase and decrease in proportion to the gate voltage $E_G$, i.e. the output voltage $E_O$. Thus, the FET $Q_2$, the constant current circuit CC as a drain load of the FET $Q_2$ and the variable resistor VR constitutes an error amplifier of a very high gain (including simultaneously an comparison circuit) and a reference voltage source.

Next, description will be made of the operational characteristics of the above-stated example. The unregulated input voltage Ei which is applied across the terminals $T_1$ and $T_1'$ from the unregulated DC power source PS is applied via the FET $Q_1$ to the load L. The gate voltage $E_G$ of the FET $Q_2$ which represents a division, by the resistors $R_1$ and $R_2$, of the voltage which is applied to the load L, i.e. the output voltage $E_O$, is compared with the voltage $E_S$ across the terminals of the variable resistor VR, which voltage $E_S$ serves as a reference voltage. As a result, the component of the variation of the output voltage $E_O$ is amplified by the error amplifier which is comprised of the FET $Q_2$ and the constant current circuit CC and is in turn applied to the gate electrode of the FET $Q_1$.

Let us now suppose that the output voltage $E_O$ has elevated from the set value by the fluctuation of the input voltage Ei, the load current $I_L$ or the like. Then, the gate voltage $E_G$ will accordingly rise, so that the gate bias of the FET $Q_2$ will become less negative, resulting in a decrease in the drain-source voltage $E_{DS}$ of the FET $Q_2$. Since the source potential is constant, the variation of the drain-source voltage $E_{DS}$ will be expressed directly as the variation of the drain voltage $E_D$. As a result, the gate potential of the FET $Q_1$ is lowered, causing the gate bias of the FET $Q_1$ to become more negative, so that the internal resistance of the FET $Q_1$ will increase which, in turn, increases the drain-source voltage, i.e. increases the voltage drop caused by FET $Q_1$, so that the output voltage $E_O$ is lowered by the amount of the raised drain-source voltage. In case the output voltage $E_O$ has decreased from the set value, the gate bias of the FET $Q_2$ becomes more negative contrary to the above-stated mode, so that the drain voltage $E_D$ is caused to rise. As a result the gate bias of the FET $Q_1$ will become less negative, causing the internal resistance of this FET to decrease and the output voltage $E_O$ is increased by the amount of this decrease.

In short, the fluctuation of the output voltage $E_O$ is amplified by the error amplifier and fed back to the gate electrode of the FET $Q_1$, so that internal resistance of the FET $Q_1$ is controlled and the output voltage $E_O$ is stabilized at the set value. As stated above, since the gain of the error amplifier is very large, the degree of stability of the output voltage $E_O$ becomes extremely high.

Figure 3:
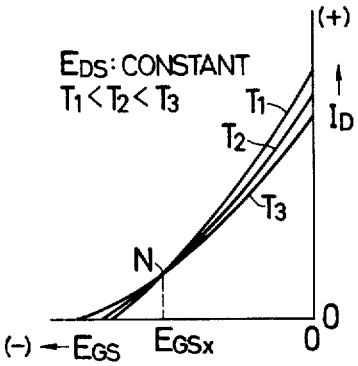
FIG. 3 is a diagram showing the $E_{GS}$-$I_D$ characteristic for explaining the effect of the ambient temperature upon a junction FET.

Moreover, due to the fact that no such element as a bipolar transistor or a voltage regulator diode which are sensitive to the ambient temperature is used in the error amplifier and in the reference voltage source, it is possible to make negligible the drift of the output voltage $E_O$ caused by the ambient temperature. In particular, as shown in FIG. 3, by the use of a vertical type junction FET having a triode characteristic which insures that the gate-source voltage $E_{GS}$ versus the drain current $I_D$ characteristic will not be affected, in a specific gate-source voltage $E_{GSO}$, by the ambient temperature, and by setting the performance conditions of such an FET, it is possible to further reduce the thermal drift of the output voltage $E_O$.

On the other hand, this output voltage $E_O$ can be set at an arbitrary value by altering the reference voltage $E_S$ within such a range as will not unstabilize the behavior of the FET $Q_2$ by adjusting the resistance value of the variable resistor VR. Thus, this output voltage $E_O$ can have a wide range of variation.

Figure 4:
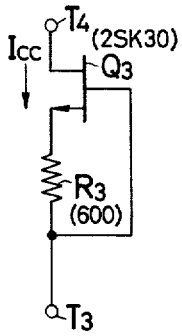
FIGS. 4 and 5 are electric circuit diagrams showing examples of constant current circuits.
Figure 5:
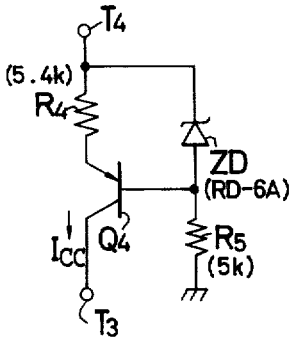

As the constant current path CC, a very simple circuit as shown in FIGS. 4 and 5 may be adopted. The circuit shown in FIG. 4 is of the arrangement that a resistor $R_3$ is connected between the source electrode of an FET $Q_3$ having either a pentode characteristic or a triode characteristic and a terminal $T_3$, and the gate electrode of this FET $Q_3$ is connected to said terminal $T_3$ and the drain electrode is connected to a terminal $T_4$. Thus, the current $I_{CC}$ will take a constant value which is determined by the resistor $R_3$. Also, the circuit shown in FIG. 5 is widely used in, for example, supplying a constant current to a voltage reference diode in the conventional DC voltage regulating circuitry. It has a resistor $R_4$ connected between the emitter electrode of a bipolar transistor $Q_4$ and a terminal $T_4$ and the voltage between the base electrode of this transistor $Q_4$ and the terminal $T_4$ is kept constant by a Zener diode ZD. The current $I_{CC}$ is determined substantially by the voltage across the terminals of the Zener diode ZD and by the resistor $R_4$. The symbol $R_5$ represents a resistor for passing a current to the Zener diode ZD.

In the above-discussed example, the terminal $T_4$ of the constant current circuit CC is connected to the output terminal $T_2$ side. If, however, it is permissible to sacrifice the stability of the output voltage $E_O$ to some small extent, the terminal $T_4$ may be connected to the input terminal $T_1$ side.

Figure 6:
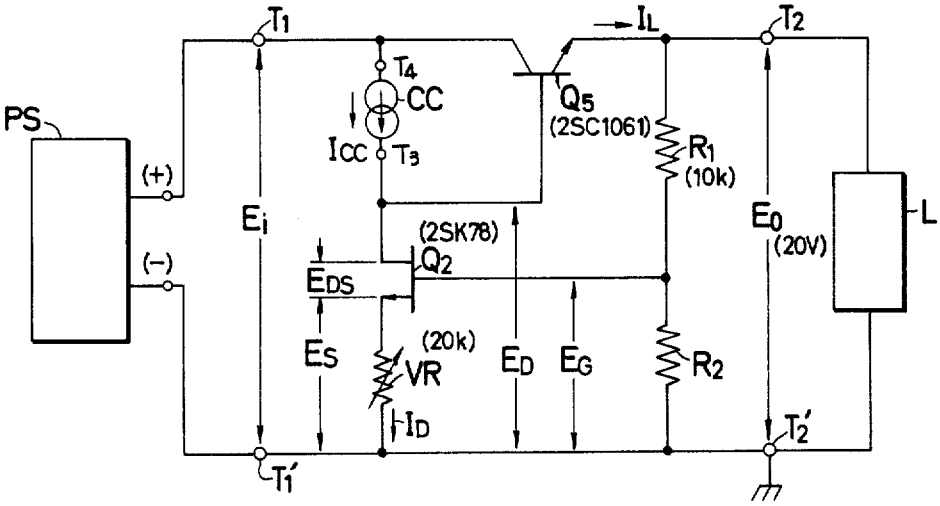
FIG. 6 is a diagram of an electric circuit showing another example of the present invention.

FIG. 6 shows another example wherein said FET $Q_1$ is replaced by a bipolar transistor $Q_5$. In this example, the transistor $Q_5$ is non-conducting so long as its base current is not flowing and thus no voltage will appear on the output terminal $T_2$ side. Accordingly, the terminal $T_4$ of the regulated current circuit CC is here connected to the input terminal $T_1$ side, to cause an immediate appearance of the output voltage $E_O$ after the input voltage Ei has been applied.

In this example, a part of the current $I_{CC}$ of the constant current circuit CC is allowed to flow to the base electrode of the transistor $Q_5$. However, by setting this current $I_{CC}$ at a sufficiently large value compared with the base current, the drain current $I_D$ of the FET $Q_2$ may be regarded constant. Thus, it practically will not be harmful to consider that the reference voltage, i.e. the voltage $E_S$ across the variable resistor VR, is constant. Also, the FET $Q_2$ has a triode characteristic and its internal resistance is sufficiently smaller than the impedance as viewed toward the base electrode of the transistor $Q_5$. Accordingly, there arises no fear that the gain of the error amplifier will drop.

The behavior of the circuitry of this example may be considered as being similar to that of the preceding example.

In the description of the present invention, the FET's $Q_1$ and $Q_2$ are shown as N-channel FET's, and the transistor $Q_5$ is shown as an NPN type transistor. It should be understood that, in case the input voltage Ei has an opposite polarity, they are to be replaced by a P-channel FET and a PNP type transistor, respectively. Also, the detecting circuit has been shown as being comprised of two resistors $R_1$ and $R_2$. They, however, may be replaced by a potentiometer or the like. Furthermore, as the means for causing a constant drain current to flow to the FET $Q_2$, there may be utilized any regulated current source in a wide sense of meaning, not limiting to the described constant current circuit CC. And still further the FET's $Q_1$ and $Q_2$ and the bipolar transistor $Q_5$ may be of a compound configuration such as a Darlington connection by plural transistors.

I claim:

1. A direct current voltage regulating circuit comprising:

an input terminal;

an output terminal for delivering an output voltage;

a variable resistance element connected in series between said input terminal and said output terminal, said variable resistance element having a control terminal, the internal resistance of said variable resistance element being controlled by an electric signal coupled to said control terminal;

a detecting circuit for providing a detected voltage representing said output voltage; and a voltage amplifying circuit having an input and an output, and including an FET having a triode characteristic, a constant current circuit serving as the load of said FET, said detected voltage being coupled to the input of said voltage amplifying circuit, the output of said voltage amplifying circuit being connected to the control terminal of said variable resistance element.

2. The direct current voltage regulating circuit according to claim 1 wherein said constant current circuit is connected between the drain electrode of said triode characteristic FET and said output terminal, and wherein said variable resistance element is an FET having a drain electrode connected to said input terminal, a source electrode connected to said output terminal and a gate electrode connected to the drain electrode of said triode characteristic FET.

3. The direct current voltage regulating circuit of claim 1 wherein said constant current circuit is connected between the drain electrode of said triode characteristic FET and said input terminal, and wherein said variable resistance element is a bi-polar transistor having a collector electrode connected to said input terminal, an emitter terminal connected to said output terminal and a base terminal connected to the drain electrode of said triode characteristic FET.

4. The direct current voltage regulating circuit of claim 1 wherein said triode characteristic FET is a junction FET, and wherein the gate-source voltage of said FET is set at a value at which the drain current is not affected by a change in the ambient temperature about said circuit.

5. The direct current voltage regulating circuit of claim 1 wherein said detecting circuit is a voltage divider circuit comprising two resistors connected in series.

6. A direct current voltage regulating circuit comprising:

an input terminal;

an output terminal for delivering an output voltage;

a variable resistance element connected in series between said input terminal and said output terminal, said variable resistance element having a control terminal, the resistance of said variable resistance element being controlled by an electric signal coupled to said control terminal;

a detecting circuit for providing a detected voltage representing said output voltage; and a voltage amplifying circuit having an input and an output, said voltage amplifying circuit including an FET having a triode characteristic, said FET having a gate electrode connected to said input, a drain electrode connected to said output and a source electrode;

a resistor connected in series to the source electrode of said FET; and a constant current circuit serving as a load for said FET, said detected voltage being coupled to the input of said voltage amplifying circuit, the output of said voltage amplifying circuit being connected to the control terminal of said variable resistance element.

7. A direct current regulating circuit according to claim 6 wherein said resistor connected to the source of said FET is a variable resistor.

* * * * *